US008402772B1

(12) United States Patent
Duval et al.

(10) Patent No.: US 8,402,772 B1
(45) Date of Patent: Mar. 26, 2013

(54) APPARATUS FOR HEATING AND COOLING BY SURFACE CONTACT

(75) Inventors: Landon Duval, Aliso Viejo, CA (US); Edwin M. First, Mission Viejo, CA (US)

(73) Assignee: Superior Inventions Group, LLC, Laguna Nigel, CA (US)

( * ) Notice: Subject to any disclaimer, the term of this patent is extended or adjusted under 35 U.S.C. 154(b) by 840 days.

(21) Appl. No.: 12/380,997

(22) Filed: Mar. 6, 2009

(51) Int. Cl.
*F25D 5/00* (2006.01)
*F25D 5/02* (2006.01)

(52) U.S. Cl. ..... 62/4

(58) Field of Classification Search ..... 62/4, 529, 62/530, 259.3
See application file for complete search history.

(56) References Cited

U.S. PATENT DOCUMENTS 3,411,156 A * 11/1968 Feher ..... 2/2.11
3,986,505 A * 10/1976 Power ..... 128/846
4,470,263 A 9/1984 Lehovec et al.
4,507,114 A * 3/1985 Bohman et al. ..... 604/111
4,551,857 A 11/1985 Galvin
5,603,728 A 2/1997 Pachys
5,887,437 A * 3/1999 Maxim ..... 62/4
5,970,718 A 10/1999 Arnold
6,023,932 A 2/2000 Johnston
6,109,338 A 8/2000 Butzer
6,125,636 A 10/2000 Taylor et al.
6,440,160 B1 * 8/2002 Cordani et al. ..... 607/114
6,567,696 B2 5/2003 Voznesensky et al.
6,910,931 B1 6/2005 Nakase
6,927,316 B1 8/2005 Faries, Jr. et al.
6,948,322 B1 9/2005 Giblin
7,022,945 B1 * 4/2006 Western ..... 219/386
7,107,629 B2 9/2006 Miros et al.
7,117,687 B2 10/2006 Naaman
7,119,279 B2 * 10/2006 Niehaus et al. ..... 174/72 A
2003/0167559 A1 9/2003 How et al.
2003/0189968 A1 * 10/2003 Lu et al. ..... 374/45
2005/0149153 A1 7/2005 Nakase
2006/0191270 A1 8/2006 Warren
2006/0191277 A1 8/2006 Defosset
2007/0199137 A1 8/2007 Numes Ramos De Carvalho et al.

* cited by examiner

*Primary Examiner* — Chen Wen Jiang
*Assistant Examiner* — Webeshet Mengesha
(74) *Attorney, Agent, or Firm* — Patent Law & Venture Group; Gene Scott

(57) ABSTRACT

A thermal treatment apparatus is built around an enclosure having pairs of separate compartments with each pair separated by a portal gate. The enclosure has a means for securing it in intimate contact with a skin surface. A chemically activatable substance is enclosed within one or more of the compartments and an activator is enclosed under pressure within one or more further compartments. A thermal sensor is positioned in contact, or near contact, with the skin surface, and a means for opening the portal gate, in accordance with a set point temperature and the actual temperature of the skin surface, is provided. Upon opening the portal gate, the activator is driven into contact with the chemically activatable substance thereby producing a chemical reaction causing a thermal exchange between the enclosure and the skin surface so as to cool or heat it.

3 Claims, 3 Drawing Sheets

APPARATUS FOR HEATING AND COOLING BY SURFACE CONTACT

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

SEQUENCE LISTING

Not applicable.

BACKGROUND OF THE INVENTION

1. Field of the Present Disclosure

This disclosure relates generally to an apparatus for cooling or heating a selected surface, and particularly, such an apparatus that is highly portable, requires no electrical input to produce its thermal effect, and is inexpensive enough to allow it to be discarded after one use.

2. Description of Related Art Including Information Disclosed Under 37 CFR 1.97 and 1.98

Devices to actively effect cooling and heating fall into several basic categories. Heat pump type air-conditioning devices provide a closed loop system that compress and expand gas without releasing it in order to provide a low-temperature interface. These systems are heavy, but can be built to offer tremendous cooling loads. Evaporative coolers use an open loop system typically relying on the evaporation of water to effect cooling. As evaporation occurs, the phase change energy of the liquid draws heat from the air. These systems work well in dry environments, but their efficiencies drop drastically as ambient humidity rises. Further, they do not work well in confined spaces, since when airflow approaches zero, so too does the evaporative cooling achieved. Still, certain cooling element inserts for garments have been developed for soaking in water to cool by the evaporative process. In a similar vein, other types of cooling garments have been developed that include pockets for various chilling inserts. Water, gel and more sophisticated phase change materials have been used as the thermal capacitance medium for such inserts. Endothermic reactive packages, as for instance portable or on-demand ice packs, have been used for manual application, and in garments, helmets, etc. Still other articles have been designed to include heat-exchange coils or conduits in communication with a circulating or flushing fluid source in order to cool or maintain workers or others exposed to extreme environmental conditions. The conduits and fluid in such articles may simply be provided for heat transfer purposes or, alternatively, to feed an evaporative cooling process. Solid-state electronic Peltier devices are available but present mobility problems as they require significant electrical energy to operate. Another type of device known as a vortex tube runs on a compressed air input and outputs separate hot and cold air jets. Votrec Corporation has applied such technology to a system in which compressed air provided by a remote compressed gas source powers a vortex tube cooling apparatus which, in turn, pumps cooled air into a vest that is delivered to a user by way of a perforated lining. However, system portability is limited by the requisite power source.

The following prior art teaches the current state of the subject field.

Numes Ramos De Carvel et al., US 20070199137, discloses an autonomous system and a method that allows the active thermal control of garments using solar cells as the power source. In the simplest configuration, the system includes a piece of clothing with solar cells, a thermal module able to generate heat and cold, and a unit for controlling and monitoring the internal environment. In order to increase versatility and to optimize operating conditions, the system includes batteries that can be charged by the solar cells or externally, increasing energy autonomy and improving performance in low radiation conditions. Proper distribution of electric resistors and refrigeration pipes allow a fine-tuning regulation of temperature inside the garment. The garment is developed not only for standard conditions but also for extreme heat and cold environments, being optimized for standard solar radiation or other relevant spectral source.

Defosset, US 20060191277 discloses a pressurized gas source feeding an array of exhaust lines or conduits in association with a user-worn or retained garment, thereby offering portable cooling systems. The system is optionally adapted to provide powered cooling to locations where only very small and portable cooling systems can fit. Various user retainable appliances or articles may have cooling features incorporated therein including helmet and torso garments. The wearer of one such device integrating cooling features as described would experience cooling to the head or chest, respectively. Other user-wearable articles and associated cooling targets are contemplated as well. To provide the intended cooling effect, a conduit system in connection with a pressurized gas source which is tuned, without nozzles or orifices, by way of various pipe-flow parameters to deliver a programmed distribution of cooling gas. Greater cooling effect may be targeted toward "hot" spots; alternatively, uniform cooling flow distribution may be achieved.

Warren, US 20060191270 discloses an air conditioning system for a garment that is worn over the clothing of an individual that utilizes a thermoelectric heating and cooling system that allows an individual to control the temperature under the garment. The garment protects the individual from extreme external temperatures in the environment. The system also prevents the buildup of humidity within the garment since the air that is heated or cooled by the thermoelectric device is dehumidified before it enters the garment. The air conditioning mechanism is mounted in a self-contained enclosure that is insulated from ambient temperature.

Nakase, US 20050149153, discloses a body temperature adjuster which is easy to wear, comfortable to wear, and provides safe and effective adjustment of body temperature. A length adjustable band member including a plurality of first storages and a plurality of second storages for storing temperature-adjusting members for adjusting the body temperature are provided, and when the wearer puts on the band member, the first storages are disposed at positions contacting the armpits where auxiliary arteries are located, and the second storages are disposed at positions contacting both sides of the neck where common carotid arteries are located.

How et al., US 20030167559, discloses a method and two apparatuses enabling refrigerated wearing and dressing. A refrigerant substance in condensed phase undergoing sublimation or evaporation into gaseous phase will absorb heat. By convection the gaseous phase is moved onto areas surrounding a wearing or a dressing, so that temperatures nearby can be lowered, resulting in improved. Refrigeration in this manner is effective, since sublimation heat and evaporation heat are much more pronounced than can otherwise be obtained via using a battery. Refrigerant can be placed in a container providing convenience in use, allowing for refill or replacement when depleted. Refrigerated clothes, hats, hamlets, etc., are in great need by our communities, in situations whenever it requires walking across air-conditioned stations, working under the sun or before a furnace, driving a motorcycle with an air-tight hamlet, and so forth.

Naaman, U.S. Pat. No. 7,117,687 discloses that the present invention provides an air conditioning garment for air conditioning an individual wearing said garment. The garment comprises an inner layer of a three-dimensional netting structure enclosed between two layers of substantially air-impermeable fabric, wherein the layer facing the wearer's body has a plurality of openings directed toward predetermined locations on the body. The garment has an inlet opening with connection means for connecting the inner layer to a source of air at a predetermined temperature.

Miros et al., U.S. Pat. No. 7,107,629, discloses that one embodiment of the present invention is apparel that includes: (a) a heat exchanger adapted to be worn in close proximity to a portion of a body; (b) a garment adapted to cover the heat exchanger; and (c) a multiplicity of anchors that couple the heat exchanger and the garment at a multiplicity of anchor locations.

Giblin, U.S. Pat. No. 6,948,322, discloses a thermionic heating and cooling device for heating or cooling a portion of a user's body utilizing thermal diodes having a first surface in thermal contact with a flexible thermal transfer band strapped to a portion of the user's body and a second surface spaced apart therefrom with a thermally conductive porous carbon foam heat sink secured to their second surface which is partially enclosed by a shroud and a surrounding air filter. A small enclosure worn by the user contains an air pump, a battery and a switch. A flexible conduit connects the air pump and shroud and draws ambient air through the porous carbon foam medium. The thermal diodes are connected to the battery by leads extending through the conduit. A voltage bias between the diode surfaces creates a cold surface and hot surface opposite each other and causes electrons to flow in one direction and transfer heat from the first surface to the second and into the heat exchanger, and the heat is prevented from returning to the first surface.

Faries, Jr. et al., U.S. Pat. No. 6,927,316, discloses that a thermal treatment garment of the present invention includes an outer structure layer formed of a pliable material, an interior lining formed of a gel material which directly contacts the wearer's skin and a thermal treatment layer to thermally treat and control temperature of the interior lining. The thermal treatment layer heats and/or cools the gel material to a desired temperature and is typically disposed between the structure and gel layers. The thermal treatment layer is controlled by a controller that receives a user-specified or desired temperature. An intervening layer can be disposed between the thermal treatment and structure layers. The intervening layer secures the structure, thermal treatment and/or gel layers to each other and can be an elastomeric material to which the gel and/or thermal treatment layers readily adhere. The garment may be adjustable in size to snugly fit body parts of users in a range of body sizes.

Nakase, U.S. Pat. No. 6,910,931, discloses a life-saving device including means for allowing the wearer to be found easily, and a body temperature adjuster for maintaining the body temperature of the wearer at a proper body temperature by fine-adjusting the body temperature of the wearer depending on the outside temperature or the body temperature prior to the time that the wearer is rescued. The life-saving device includes heating members disposed so as to contact both sides of the neck where common carotid arteries are located, and both armpits where auxiliary arteries are when the main body of the life-saving device is worn, a power source for supplying electricity to the heating members, a body temperature detecting means for detecting the body temperature, an outside temperature detecting means for detecting the outside temperature, and a temperature controller for adjusting the temperature of the heating members in response to the temperature detected by the body temperature detecting means and the outside temperature detecting means, so that the body temperature of the wearer can be maintained at a proper temperature in case of emergency.

Voznesensky et al., U.S. Pat. No. 6,567,696, discloses that a physiotherapeutic device for concurrently applying heat and electrical stimulation to a localized treatment area comprises a heat transfer medium for placing in contact with the treatment area, the heat transfer medium having a heat capacity such that the device is operable to change a temperature of said heat transfer medium from a temperature able to induce a burn to a safe temperature substantially within a minute.

Taylor et al., U.S. Pat. No. 6,125,636, discloses a self-contained personal cooling and/or heating device which includes a heat dissipating member that fits around a portion of the user's body to be thermally regulated. A Peltier thermovoltaic module operated with low voltage at relatively low current is thermally coupled to the rear surface of the member, and the rear surface of the module is provided with a large surface area, preferably augmented by a heat sink. A fan directs ambient air onto this rear module surface or heat sink. The device preferably is controlled by a microprocessor that biases the module with a pulse train, samples temperature across the module during an off-portion of the pulse train, and used sampled signals to vary duty cycle and/or amplitude of the voltage across the module to finely control temperature. The device preferably is controlled by a self-contained battery source whose polarity across the module is user-changeable, causing the device to heat or cool the user as desired.

Butzer, U.S. Pat. No. 6,109,338 discloses an article for use in cooling body temperature which comprises a garment having a coat and pant, with each having a body section adapted to receive a portion of the torso of the wearer and extensions from the body section to receive the wearer's limbs. The garment includes a system for circulating temperature controlling fluid from a suitable source through patches removably received in pockets in each body section and their extensions.

Johnston, U.S. Pat. No. 6,023,932 discloses a portable topical heat transfer device for topically cooling an animal or human when required such as to relieve pain and swelling from injured joints or muscles or the like. The device comprises a thermoelectric unit having a cold side and a warm side, a DC source which is connected to the thermoelectric unit, a heat sink which is mounted in a heat conductive relationship with the warm side of the thermoelectric unit, a fan for removing heat from the heat sink, and a strap or the like for securing the device to the body of a person.

Arnold, U.S. Pat. No. 5,970,718 discloses a personal heat control having a housing accommodating a Peltier-effect unit, one or more batteries and a timing switch for selectively energizing the unit. The housing is releasably attached to a part of a person's body, e.g. the wrist, by a strap with a cooling surface cooled by the unit in contact with the body part to enhance heat transfer between the person's body and the surrounding air for comfort and refreshment purposes when the unit is energized.

Pachys, U.S. Pat. No. 5,603,728 discloses a scalp apparatus for regulating the temperature of the scalp of a wearer. The scalp apparatus includes a helmet for coveting the hair bearing scalp of the wearer, spacing means to provide an air space between the helmet and the scalp of the wearer and relating apparatus for regulating the temperature of the helmet so as to relate the temperature of the air space such that the scalp of the wearer is maintained at a desired temperature. The relating apparatus can be in the form of thermoelectric elements and a power supply for providing electrical power to the thermoelectric elements or a potion of piping and a source of fluid for providing a flow of liquid through the potion of piping. The apparatus can further include an apparatus for controlling the regulating apparatus. The scalp apparatus can be employed for cooling the scalp of a wearer to combat the problem of alopecia during chemotherapy treatment or for warming the scalp of the wearer during heat treatments.

Galvin, U.S. Pat. No. 4,551,857 discloses a hat having a solar-powered Peltier-effect thermoelectric device mounted to a headpiece such that the cold surface of the thermoelectric device is in communication with the forehead of the wearer and the hot surface of the thermoelectric device is in communication with ambient atmospheric air. A thermally conductive strip provides heat transport between the forehead and the cold surface. A finned radiator provides radiative and convective heat transport between the hot surface and ambient air.

Lehovec et al., U.S. Pat. No. 4,470,263, discloses a Peltier cooling device. In one embodiment Peltier cells are attached to a garment with the cold plate of the Peltier cell in intimate thermal contact with the skin of the wearer of the garment. Heat generated by the Peltier cell is dissipated to the ambient from cooling fins. Heat pipes are used to conduct the heat to the fins, or to distribute the cooling across the skin.

Kenji et al., 2004263325(JP), discloses a thin air-conditioning garment using Peltier devices having good workability, where cooling/heating can be switched according to circumstances or places and temperature can be regulated.

Fisher & Paykel Ltd, EP 1080648, discloses a personal cooling system which has a user wearable garment incorporating a fluid path from an inlet port to an outlet port. The fluid path may be in the form of a fluid fillable envelope. A cooling unit is adapted to receive a supply of fluid and to reduce the temperature of the supply and admit the cooled fluid. A reservoir receives cooled fluid from the cooling unit. A pump is able to pump fluid from the reservoir through a conduit to the user wearable garment.

Monk, GB2433834, discloses a garment for a motorcycle rider which is actively heated or cooled using a closed loop pumped fluid circuit comprising a garment having fluid ducts, a fluid reservoir, a pump, and a heat exchanger assembly comprising a fluid heat block, Peltier thermo-electric element, heat skin and fan. The reservoir, pump and heat exchanger are preferably mounted on and powered by a motor cycle with umbilical tubing connecting to the riders garment via self-sealing couplings. The cooling fluid is preferably water. The system can be driven to actively cool or heat the rider's garment depending on the polarity of the Peltier element current. The garment may be an under-vest or jacket. Electronic temperature control of the heat exchanger and Peltier element may be provided.

Brunel University, GB2362803, discloses a temperature regulated garment including one or more heating elements and/or one or more cooling elements located to cool directly only a part of a wearer's torso. Two or more heating elements are located at a front of the garment and a heating element located at the rear of the garment. A cooling element is provided in a collar of the garment. The garment is preferably in two parts, with the heating/cooling elements and battery in an inner part and a control input on an outer part.

The related art described above discloses several heating and cooling devices for application to the human skin surface. However, the prior art fails to disclose a device that is able to be placed into contact with the skin surface and providing cooling and heating by mixing chemicals in adjacent compartments. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

It is well known that certain thermally sensitive skin surfaces of the human body ("the body") may be used more effectively than other surfaces for producing a heating or cooling effect to the entire body. For instance, the scalp, the neck adjacent to the carotid artery, the arm pits, and the underside of the wrists are thermally sensitive skin surfaces of this type. The present invention may take the form of an adhesive patch or of a bandage or wrap that is able, when placed into intimate contact with one or more of these skin surfaces, to effectively produce a rapid heating or cooling effect to the entire body. The present invention is able to deliver or extract heat from the body and control a temperature level at the skin surface. When a person is entering a cold or heat shock condition, the application of the present invention can make the difference between life or death. Because the present invention takes the form of a bandage or plaster, it may be easily stored within and carried in a first-aid kit or in a jacket pocket, for instance, so that it is readily available for use in an emergency. Because the present invention requires no training in its use, it may be applied by the person in need, or by a third party at any time it is required.

The present invention is a thermal transfer apparatus preferably taking the form of a bandage, pad or wrap and has an essentially flat conformation with a relatively large surface area on one side. An enclosure provides pairs of separate compartments with each pair separated by a portal gate. A means for maintaining intimate contact with the skin surface is provided. A chemically activatable substance is enclosed within one or more of the compartments and an activator is enclosed, under pressure, within one or more further of the compartments where activator compartments are separated from chemically activatable substance compartments by the portal gates. A thermal sensor is positioned in contact, or near contact, with the skin surface and a means for opening one or more of the portal gates, in accordance with skin surface temperature, is operational. Upon opening a portal gate, the activator is driven, by the pressure within its compartment, into contact with the chemically activatable substance in the adjacent compartment, thereby producing a thermal reaction, a heating or cooling effect, causing a thermal exchange between the enclosure and the skin surface so as to cool or heat the skin surface and the blood carrying vessels below the skin surface.

The present invention may be used in non-medical applications such as for cooling a wine bottle. In this application, the invention may be attached to the bottle outer surface and used for cooling the wine. Also, the invention may be used with food or beverage containers, cups, glasses, mugs, and so on, for cooling or heating a beverage.

A primary objective of the present invention is to provide advantages not taught by the prior art.

Another objective is to provide an adherent patch, wrap, or strap-on device capable of intimately contacting a surface requiring heating or cooling.

A further objective is to provide the device in a form that is inexpensive to produce and use so as to be accepted as a one-use product able to be discarded thereafter.

A further objective is to provide a cooling or heating effect on a selected surface.

A further objective is to provide the thermal effect by simply combining two substances.

A further objective is to combine the two substances through a gate functionally dependent on the temperature of the surface.

A further objective is to extend the thermal effect by serial operation of the combining operation.

A further objective is to control the temperature of the surface about a set point by serial operation of the combining operation using opposing thermal effects.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

Figure 1:
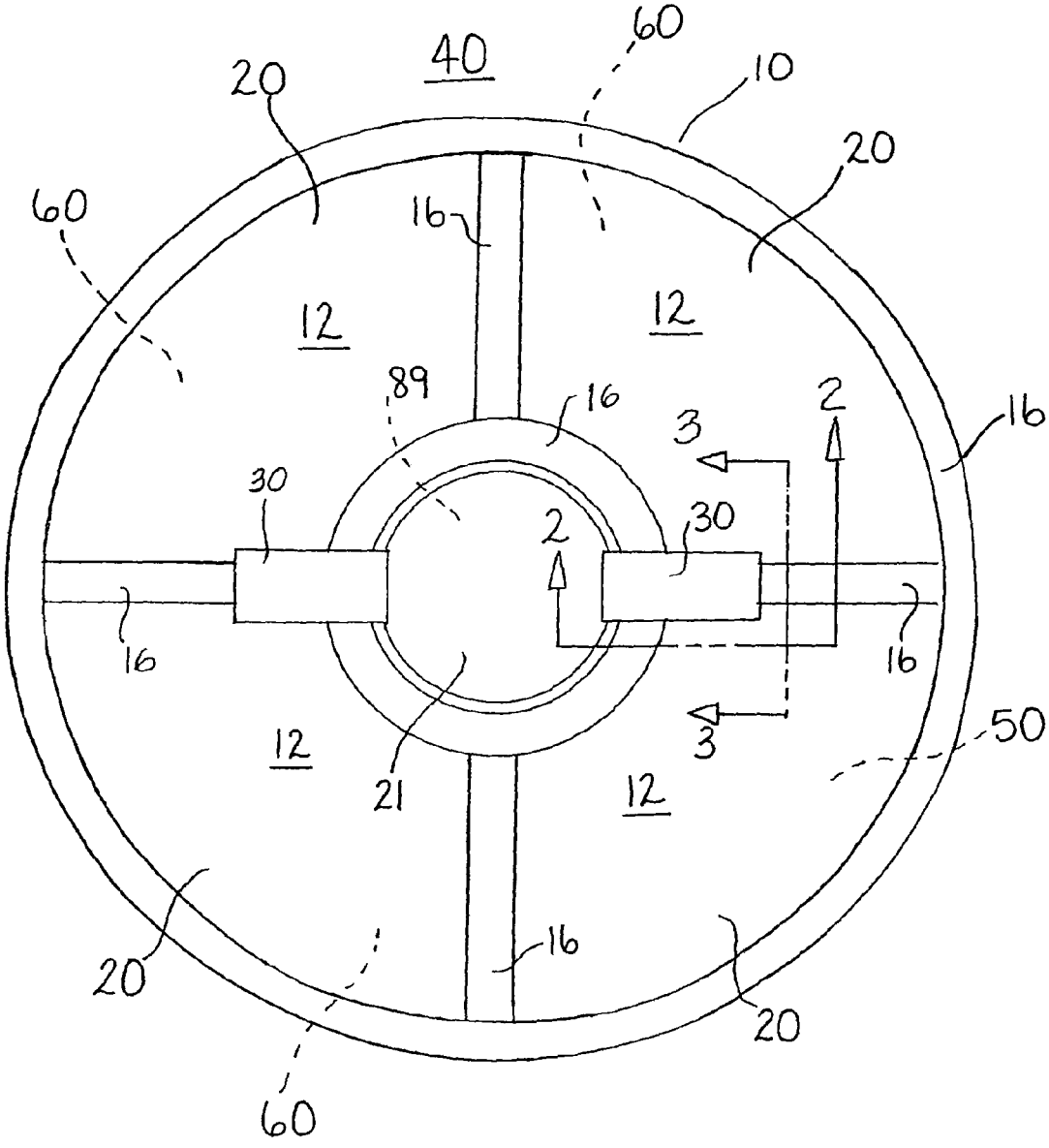
FIG. 1 is a top plan view of the presently described apparatus.

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it should be understood that what is illustrated is set forth only for the purposes of example and should not be taken as a limitation on the scope of the present apparatus and its method of use.

Described now in detail is a thermal treatment apparatus that is highly portable, requires no electrical input to produce its thermal effect, and is inexpensive enough to allow it to be discarded after one use. Please refer to FIGS. 1-6. The apparatus is built within an enclosure 10 having compartments 20 separated from each other with each pair of the compartments 20 joined by a portal gate 30. A means for securing the enclosure 10 in intimate contact with a surface 40 is provided. A chemically activatable substance 50 is enclosed within one or more of the compartments 20 and an activator 60 is enclosed under pressure within one or more further compartments 20, where each of the compartments 20 holding the activator 60 is adjacent to each of the compartments 20 holding the chemically activatable substance 50 and separated by a portal gate 30. A thermal sensor 70 is positioned in contact, or near contact, with the surface 40, and a means for opening the portal gate or gates 30 in accordance with a selected set point and measured skin temperature. Upon opening the portal gate 30, the activator 60 is driven from its compartment 20 into the compartment 20 holding the chemically activatable substance 50 thereby mixing the activator 60 with the chemically activatable substance 50. This produces a thermal reaction causing a thermal exchange between the enclosure 10 and the surface 40. Clearly, by opening gates 30 in sequence, the thermal effect may be expanded in time. If more than one of the chemically activatable substances is used in different ones of the compartments 20, it is possible to refine the thermal effect, that is, provide fine adjustment of the temperature, and even reverse it.

Figure 5:
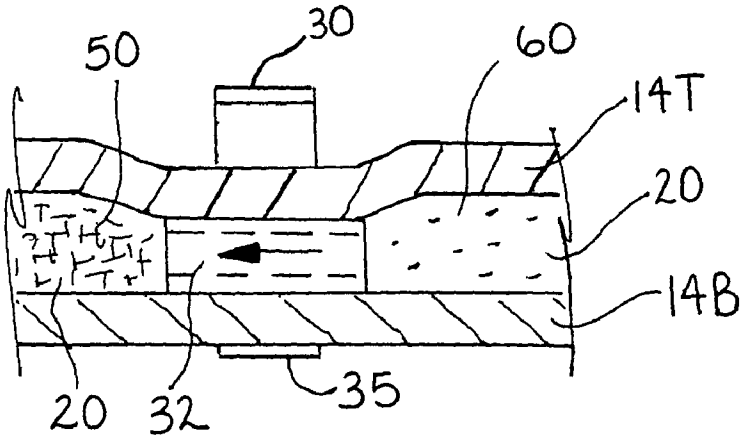
FIG. 5 is a sectional view taken along line 3-3 in FIG. 1 showing the portal gate in the open attitude.
Figure 3:
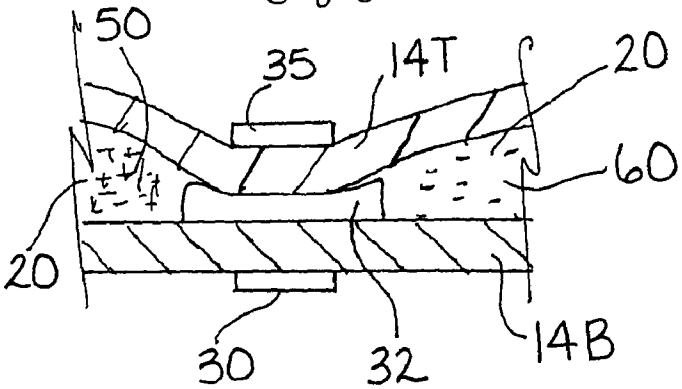
FIG. 3 is a sectional view taken along line 3-3 in FIG. 1 showing the portal gate in the closed attitude.
Figure 4:
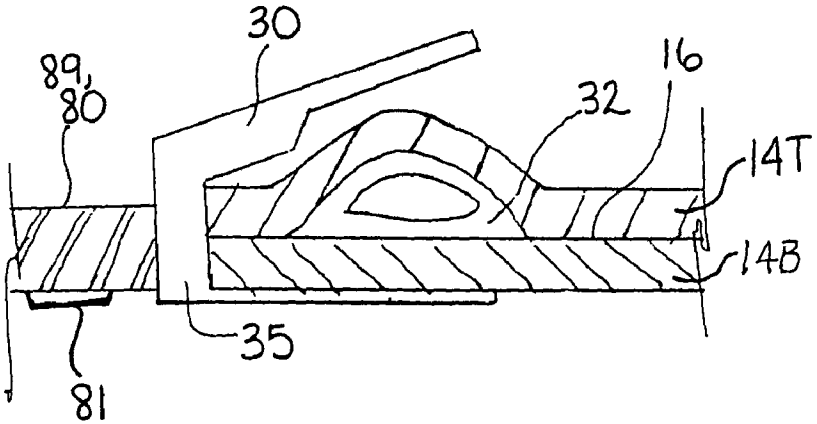
FIG. 4 is a sectional view taken along line 2-2 in FIG. 1 showing the portal gate in an open attitude.

The enclosure 10 is preferably costructed of flexible sheet material 12 such as a high density polyethelyne or other stock materials. As shown in FIG. 1, the preferred format of the enclosure 10 is disc shaped although other shapes are equally useful. A circular bottom layer 14B of the sheet material is covered by a top layer 14T. The bottom layer 14B is preferably of a thermally conductive material for improved performance of the invention. A central compartment 21 is formed by joining the two layers 14B and 14T with an inner circular seal 16. Seal 16 may be a heat seal, an adhesive bonded seal or other sealing technique well known in the art. Preferably an operating circuit 80 mounted on a circuit board 89, is mounted within the inner circular seal 16. The plastic layers 14B and 14T are not shown I FIGS. 2-4 for clarity. Next linear radial seals 16 are made thereby forming a circular arrangement of adjacent compartments 20. The radial seals 16 between selected adjacent pairs of the compartments 20 are made over portal gate tubes 32, which are highly flexible and therefore closed when pressure is applied to them, so that the material in one of the pairs of adjacent compartments 20 may be excluded from its neighbor compartment 20, see FIGS. 2 and 3. When pressure on tubes 32 is released, they form an open conduit between the adjacent compartments 20, as shown in FIGS. 4 and 5. Finally, after placing the chemically activatable substance 50 into one of the adjacent compartments 20 and the activator 60 in its neighbor compartment 20, an outer circular seal 16 is made thereby sealing the substances 50 and 60 within their compartments 20. The activator 60 is placed into its compartment 20 under pressure, for instance, one pound above atmospheric pressure.

Portal gates 30 include a bimetallic spring element 35 and the gate tube 32. When a small current is delivered to the bimetallic spring element 35 it releases pressure on tube 32 as shown in FIGS. 4 and 5. Details of the sping element 35 is not shown here in that such devices are extremely well known in the art.

The means for securing the enclosure 10 in intimate contact with the surface 40 is preferably a strap with hook and loop surface fastening material for providing a consistant pressure. Alternatively, the securing means may be an adhesive which is preferably placed so as not to interfere with thermal transport between the skin surface and the enclosure 10. Many other securing means may be used as well and the securing means is not shown since they are well known in the art.

The chemically activatable substance 50 and the activator 60 may be any pair of substances that are thermally functional for producing endothremic or exothermic reactions. However, the activator 60, in order to be forced from its original compartment 20 into intimate mixing contact with the activatable substance 50 through the gate portal 30 must be a liquid or possibly a gas or vapor. The preferred activator is deionized water. The chemically activatable substance 50 may be ammonium nitrate, ammonium iodide, ammonium bromide, potassium nitrate, methylurea, urea, sodium carbonate, sodium bicarbonate or other substances, for producing an endothermic effect when combined with the activator 60. For an exothermic reation, a mixture of: sodium cloride, vermiculite, iron powder and charcoal may be used as the chemically activatable substance 50. Clearly, one of skill in the art will know of other chemical combinations that may be used in the present invention.

Figure 2:
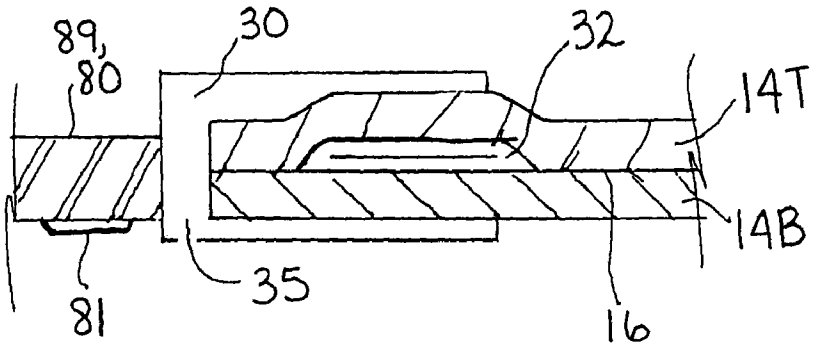
FIG. 2 is a sectional view taken along line 2-2 in FIG. 1 showing a portal gate in a closed attitude.
Figure 6:
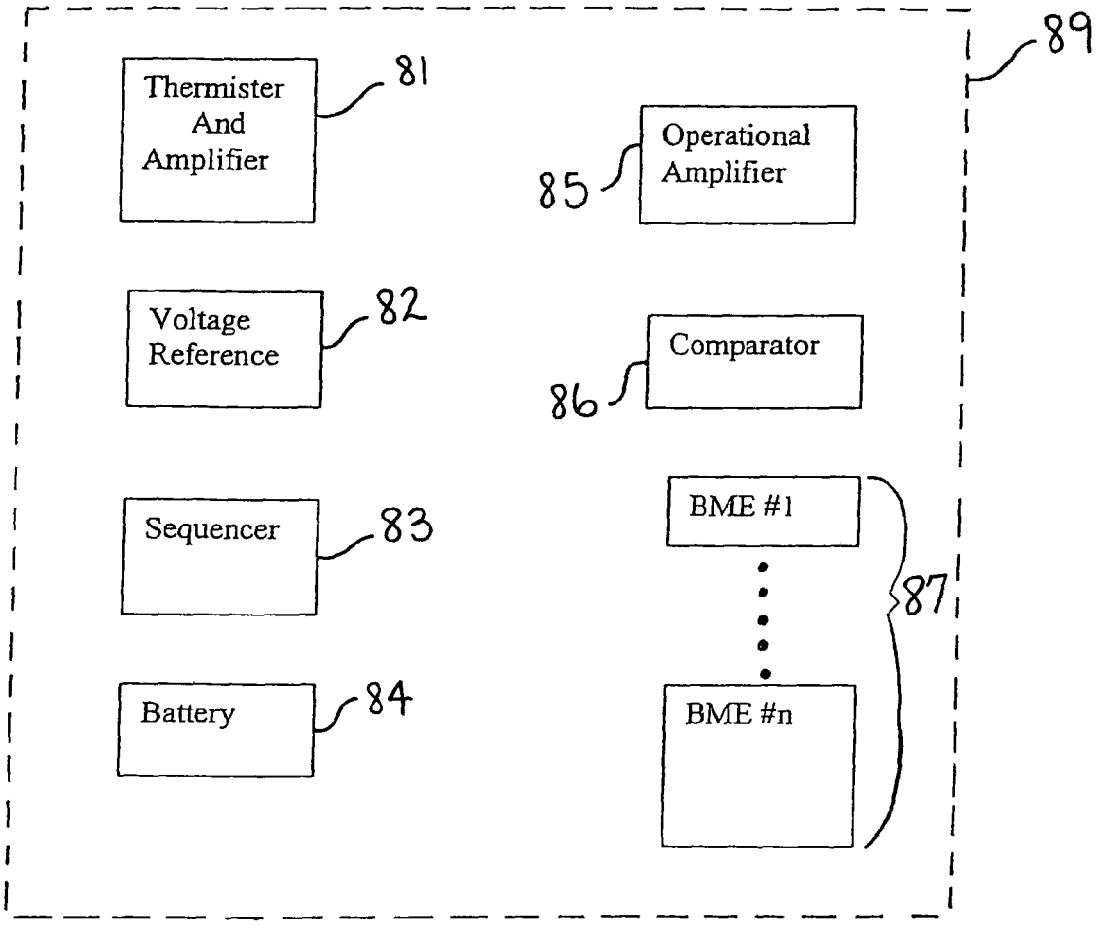
FIG. 6 is a block diagram of the components that make up an electrical circuit of the present invention.

The operating circuit 80, as shown in FIG. 6, comprises circuit elements: thermal sensor, preferably a thermistor, and amplifier 81, voltage reference 82, sequencer 83, battery 84, op-amp 85, logic comparitor 86, and bimetallic element(s) 35. These elements are mounted on the circuit board 89 including the bimetallic element 35 as shown in FIGS. 2 and 4 with the thermistor 81 on the bottom of board 89 for direct contact with the surface 40 and with the bimetallic element(s) 35 mounted on peripheral edges of the circuit board 89. Preferably the thermal sensor 81 is a thermister, and is located on the bottom surface 88 of the circuit board 89 so that it is positioned for contact, or near contact, with the surface 40. Clearly, the thermal sensor 81 can be mounted so as to penetrate the bottom plastic layer 14B so as to be in physical contact with the skin surface 40.

In operation, voltage reference 82 is adjusted to a temperature set point, as for instance a skin temperature that is typical of the onset of hypothermia in a person. When the bottom surface of the enclosure 10 is placed into intimate contact with the skin surface of the person and battery 84 is turned on, as for instance, by removing a battery terminal insulating paper, the thermal sensor 81 detects a skin temperature that is below the set point temperature and sends a corresponding signal to comparitor 86 which subtracts the skin temperature value from the set point value arriving at a positive number. The comparitor signals the operational amplifier 85 which has a driver stage that provides a current to the bimetallic element 35. The bimetallic element 35, upon heating from the current moves from its closed attitude (FIG. 3) to its open attitude (FIG. 5) allowing the acivator 60 to flow into physical contact with the chemically activatable substance 50 in the adjacent compartment 20. Since the activator compartment 20 is under pressure, the activator 60 moves rapidly between compartments 20 causing a mixing of the two substances 50, 60. When the reaction is exothermic, heat is delivered through film layer 14B to the surface 40 causing a heating of blood flow near the surface 40. When the person is suffering from heat stroke, the thermal reaction is preferably cooling thereby drawing heat from the blood system of the person through film layer 14B which is in intimate contact with the surface 40. When the temperature of the surface 40 has not changed by a magnitude sufficient to satisfy a temperature rate of change set point programmed into the comparitor, a signal is sent to the sequencer 83 which directs the opening of further bimetallic elements 35.

The apparatus may have a considerable number of compartments 20, and indeed may have many compartment pairs as would be needed for fine adjustment of temperature.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. An apparatus enabling thermal exchange with a surface, the apparatus comprising:

an enclosure having a pair of compartments, the compartments separated by a portal gate configured as a tube;

a means for securing the enclosure in intimate contact with the surface;

a chemically activatable substance enclosed within one of the compartments;

an activator enclosed under pressure within another of the compartments;

a thermal sensor positioned for contact with the surface; and a means for opening the portal gate by releasing pressure on the tube in accordance with a thermal set point in the thermal sensor, and a temperature of the surface measured by the thermal sensor;

a mixture of the activatable substance and the activator enabling a chemical reaction causing thermal exchange between the enclosure and the surface; wherein the opening means is a bimetallic element having a closed state and an open state, the bimetallic element engaged with an electrical circuit, the electrical circuit enabled for producing an electric current sufficient for moving the bimetallic element from the closed state to the open state and thereby changing the conformation and conductance of the tube.

2. The thermal transfer apparatus of claim 1 wherein the flexible tube is extensive between the pair of compartments, the flexible tube closed when the bimetallic element is in the closed state, the flexible tube open when the bimetallic element is in the open state.

3. A thermal transfer apparatus for use on a surface, the apparatus comprising:

an enclosure having pairs of compartments, each pair of said compartments separated by a portal gate comprising a tube of flexible material;

a means for securing the enclosure in intimate contact with a surface;

a chemically activatable substance enclosed within one of the compartments of each of the pairs of compartments;

an activator enclosed, under pressure, within another of compartments of each of the pairs of compartments;

a thermal sensor positioned in contact with the surface; and a means for opening each said portal gate in accordance with a thermal set point and a measured temperature;

wherein, upon opening each one of the portal gates, the activator is mixed with the chemically activatable substance, thereby producing a chemical reaction causing thermal exchange between the enclosure and the surface; and the opening means has a bimetallic element associated with each pair of compartments, the bimetallic elements engaged with an electrical circuit enabled for producing an electric current sufficient for moving each bimetallic element from a closed state to an open state.

* * * * *